US005377839A

United States Patent [19]

Relyea et al.

[11] Patent Number: 5,377,839

[45] Date of Patent: Jan. 3, 1995

[54] EXCHANGEABLE UNIT DOSE MEDICAMENT DOSING SYSTEM AND METHOD

[75] Inventors: Christopher M. Relyea, Columbus; Mark A. Relyea, Powell; Michael S. Relyea, Grove City, all of Ohio

[73] Assignee: Drustar, Inc., Grove City, Ohio

[21] Appl. No.: 96,929

[22] Filed: Jul. 23, 1993

Related U.S. Application Data

[62] Division of Ser. No. 821,480, Jan. 15, 1992, Pat. No. 5,251,757.

[51] Int. Cl.[6] ..... B65D 83/04

[52] U.S. Cl. ..... 206/531; 206/534; 206/534.1; 206/539

[58] Field of Search ..... 206/425, 468, 528, 531, 206/534, 534.1, 534.2, 539, 564, 387

[56] References Cited

U.S. PATENT DOCUMENTS

| | | | |
|---|---|---|---|
| 1,988,134 | 1/1935 | Nitardy . | |
| 3,429,426 | 2/1969 | Wolf et al. . | |
| 3,826,222 | 7/1974 | Romick . | |
| 3,921,804 | 11/1975 | Tester . | |
| 4,074,806 | 2/1978 | Ardito . | |
| 4,084,695 | 4/1978 | Halbich . | |
| 4,253,572 | 3/1981 | Halbich . | |
| 4,372,445 | 2/1983 | Keffeler . | |
| 4,384,649 | 5/1983 | Brodsky . | |
| 4,418,823 | 12/1983 | Romick . | |
| 4,574,954 | 3/1986 | Reid . | |
| 4,616,890 | 10/1986 | Romick . | |
| 4,744,463 | 5/1988 | Merzon | 206/387 |
| 4,771,887 | 9/1988 | Nehl | 206/387 |
| 4,779,730 | 10/1988 | Hartsfield et al. | 206/387 |
| 4,790,434 | 12/1988 | Schoberg et al. | 206/387 |
| 4,817,819 | 4/1989 | Kelly . | |
| 4,822,116 | 4/1989 | Relyea et al. . | |
| 4,905,866 | 3/1990 | Bartell et al. . | |
| 4,998,623 | 3/1991 | Doull . | |
| 5,019,125 | 5/1991 | Rebne et al. . | |
| 5,038,968 | 8/1991 | Albetski . | |
| 5,046,609 | 9/1991 | Mangini et al. | 206/534 |
| 5,082,114 | 1/1992 | Bunin . | |
| 5,097,946 | 3/1992 | Emrich | 206/309 |
| 5,109,984 | 5/1992 | Romick . | |
| 5,251,757 | 10/1993 | Relyea et al. | 206/534 |

FOREIGN PATENT DOCUMENTS

| | | | |
|---|---|---|---|
| 2919713 | 11/1980 | Germany . | |
| 59-5466 | 1/1984 | Japan | 206/309 |

*Primary Examiner*—David T. Fidei
*Attorney, Agent, or Firm*—Frost & Jacobs

[57] ABSTRACT

There is provided an improved exchangeable medicament dosing system and method which includes a reuseable integral patient dispensing frame which supports a plurality of reuseable cartridges. Replaceable blister packages having a plurality of individually sealed spaced pockets are slidably inserted into the reuseable cartridge and aligned with a predetermined number of dispensing openings therewithin. The blister packages are specifically designed to mechanically interact with the cartridge as they are slidably inserted to properly align the spaced pockets with corresponding dispensing openings of the cartridge. One or more cartridges are releasably locked at least partially within the dispensing frame, and a plurality of dispensing frames can be placed in a frame container for convenient exchange and use with medication carts. The resulting dosing system and method combines the advantages of punch card distribution with its excellent visual accountability and seal, with the benefits of a perpetual inventory exchange system.

13 Claims, 6 Drawing Sheets

EXCHANGEABLE UNIT DOSE MEDICAMENT DOSING SYSTEM AND METHOD

This is a divisional, of application Ser. No. 07/821,480, filed Jan. 15, 1992, now U.S. Pat. No. 5,251,757.

TECHNICAL FIELD

This invention relates to medication administration systems, and, more particularly, to an improved exchangeable unit dose medicament dosing system and method including a reuseable integral patient dispensing frame which receives and releasably supports one or more reuseable dispensing cartridges which each support a replaceable blister package of individually sealed and longitudinally spaced pockets containing medicament doses to be dispensed in accordance with a predetermined prescription.

BACKGROUND ART

Medication exchange systems, wherein a health care provider such as a long term care center or the like periodically receives prefilled medication dispensing containers in exchange for previously utilized similar containers, have been advantageously utilized in various forms. For example, as illustrated in U.S. Pat. No. 4,384,649, which issued to L. Brodsky, unit doses of medication individually sealed within disposable blister-type packs have been contained within reuseable plastic dispensers, wherein medication can be dispensed from the blister pack using finger-strength pressure. In this two-piece dispensing package, the blister pack and its cover is held within a hinged outer shell, whereupon closing of the outer shell forces a cutting edge thereof into contact with the blister pack cover, thereby forming a seal around each blister pack pocket. Dispensing devices similar to those described in the Brodsky patent have been available in the industry, such as from Wayne-Ferrell, of Smithtown, N.Y. These devices have been marketed under the name "dispens-A-dose" for use in conjunction with interchangeable drawers or cassettes in medication delivery carts and the like.

Other exchangeable unit does systems have also been available in the industry, such as illustrated in U.S. Pat. Nos. 4,084,695 and 4,253,572, which issued to F. Halbich, and U.S. Pat. No. 4,372,445, which issued to P. Keffeler. These patents generally describe plastic pill box designs which receive a plurality of unit dose tablets or the like. The pill box is sealed by a clear plastic cover having a plurality of frangible portions which enable individual compartments of the pill box to be separately opened for dispensing operations. The cover can be provided of a relatively clear or transparent material to provide visual access to the medication compartments. Similar box and frangible lid structures have been available in the industry, such as from Omni Medical Systems, Inc., of Marion, Iowa, (sold under the names "Omni 1"and "Omni 8"), and from Opus Unit Dose Systems, of Omaha, Nebr. These unit dose systems have also been marketed in conjunction with plastic dispensers which can be utilized in conjunction with medication carts.

Still other exchangeable systems have also been known, such as described in U.S. Pat. No. 3,826,222, which issued to J. Romick. This unit-dose medication handling system comprises a medication tray having a plurality of dividers for defining compartments for receiving unit-dose dispensing boxes. The dispensing boxes are generally made of cardboard and are adapted to receive a plurality of unit-dose packs of medication. The unit doses may be in the form of separate viles, capsules, envelopes, or strip packs. A pressure sensitive label is adhered to the box for identification. A tray can be utilized for a single patient, wherein a plurality of prescription boxes can be placed in the adjacent compartments, with the pharmacist filling each box with a predetermined number of unit doses. The tray can also be disposed on a shelf of a mobile medication cart for use in dispensing procedures. While systems similar to the structure described in the '222 patent have been available, the cardboard dispensing boxes tend to be only marginally reusable, of only limited effectiveness for security of individual doses (vis-a-vis pilferage), cumbersome, and provide poor visual accountability of medication.

Other forms of reuseable medication dispensing devices have also been available in the industry. For example, blister-type medication cards have been available with reuseable punch frames, such as marketed by Artromick of Columbus, Ohio under the names "TimePak-7" and "PunchPak". These devices include reuseable punch frames similar to that described with regard to U.S. Pat. No. 4,384,649 above, and are used in conjunction with blister-type packages inserted therein. These frames can also be used with and stored loosely within medication cart drawers or the like.

While there have been a variety of exchangeable unit dosing systems, such as described above, each have their own shortcomings, some of which have been detailed above. Generally, heretofore, there has not been available a single system which combines the advantages of disposable punch card packages having excellent visual accountability, high integrity seals, and low cost packaging per dose, with the benefits of exchange systems which minimize inventory and reordering requirements, minimize packaging and product waste, and increase medication security. The exchangeable systems described above, while offering some of these advantages, could not offer all of the advantages in a single, relatively simple, and substantially modular format.

Moreover, most of the exchangeable systems previously available in the industry offered only a predetermined medication administration system, set up specifically for patient pass, time pass, or prescription pass only. In most cases, the same structure which provided for reuseability and exchange characteristics also imposed severe limitations on adaptability and applicability to the ever changing environment in modern health care facilities.

DISCLOSURE OF THE INVENTION

It is an object of this invention to overcome the shortcomings and problems of the medication handling and dispensing products, systems and methods heretofore available in the industry.

It is another object of the present invention to provide an exchangeable unit does medicament dispensing system and method featuring a relatively simple structural arrangement and procedure which combines the advantages of low cost punch card delivery systems with the benefits of an exchange-type medication system.

It is yet another object of the present invention to provide a medication dosing and dispensing system and method which can be alternately set up in a variety of easy-to-use arrangements, including organization by patient (e.g., alphabetically by name, location, etc.) time (e.g., am, pm, noon, hour of sleep, etc.) and prescription, without requiring structural changes to the system itself.

It is also an object of the present invention to provide an improved exchange system which includes a combination of a reuseable integral cartridge which receives a specially adapted blister-type unit dose medication package, and a reuseable patient frame designed to readily receive and support a plurality of cartridges in releasably locked condition, and wherein individual unit doses can be dispensed without removing the cartridge from the frame.

It is yet another object of the present invention to provide an improved seven (7) day exchange system and dispensing method which utilizes a simplified structural combination of a specially designed blister-type package, a reuseable integral cartridge which slidably receives the blister package, and an integral patient frame which releasably and lockingly receives one or more cartridges to provide a patient punch frame which simplifies both loading procedures at the pharmacy and dispensing procedures at the patient care level, while allowing relatively unlimited flexibility and user defined customization.

In accordance with one aspect of the present invention there is provided an exchangeable patient dosing system for medicaments including at least one integral reuseable cartridge having longitudinally oppositely disposed first and second ends, and a medicament support surface with a plurality of longitudinally spaced dispensing openings. A replaceable blister package includes a longitudinal strip having a predetermined number of individually sealed spaced pockets corresponding in number and spacing with the dispensing openings of the cartridge, each housing a certain dose of medicament to be dispensed. This blister package is slidably insertable into and removable from the reuseable cartridge.

In a preferred embodiment, each cartridge includes seven dispensing openings and the dispensing frame comprises means for receiving and supporting up to four cartridges in order to provide a seven day exchange system for a particular patient with up to four separate prescriptions of unit dose medicaments provided for each dispensing pass. The dosing system can also be utilized with a frame container which supports a plurality of patient frames and provides both physical access to and visual identification of those frames for storage, use and exchange procedures.

In a preferred embodiment, the cartridge further includes a pair of oppositely disposed retaining tracks to slidably receive and support opposite lateral edges of the replaceable blister package, wherein at least one recess is formed along those tracks to interact with a protuberance portion of one or more of the pockets of the blister package to align the blister package and to prevent further sliding motion within the cartridge.

BRIEF DESCRIPTION OF THE DRAWINGS

While the specification concludes with claims particularly pointing out and distinctly claiming the present invention, it is believed the same will be better understood from the following description taken in conjunction with the accompanying drawings in which:

DETAILED DESCRIPTION OF THE INVENTION

Figure 7:
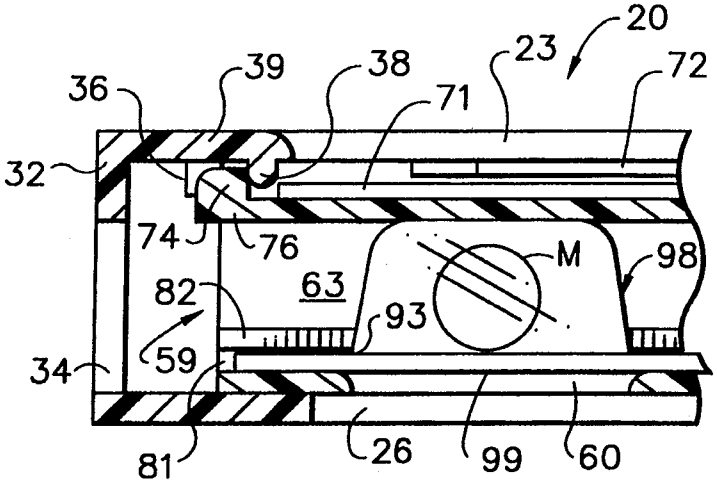
FIG. 7 is a partial, enlarged cross-sectional view of a preferred releasable locking arrangement between a cartridge and patient frame of the subject invention.
Figure 8:
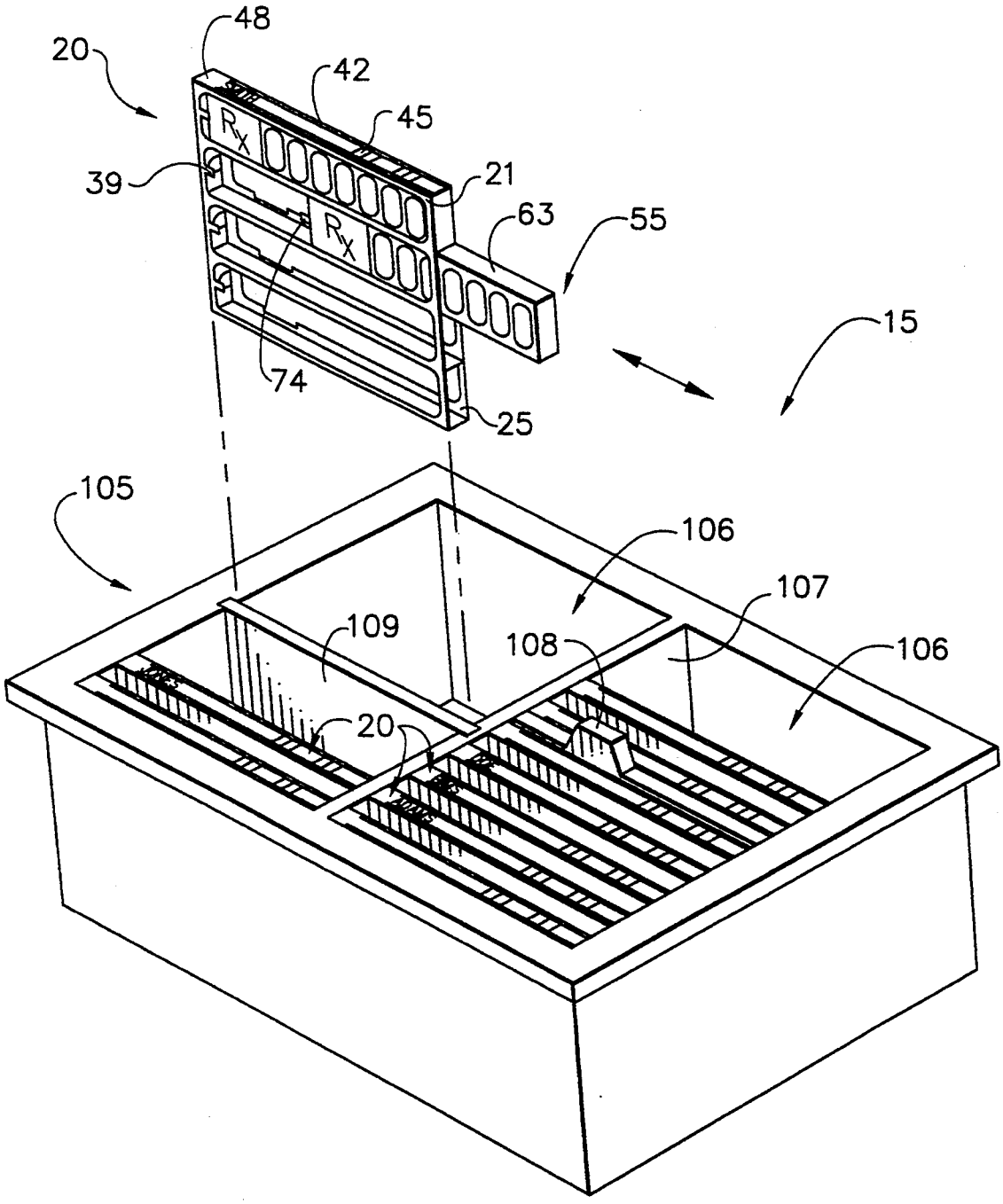
FIG. 8 is a partially exploded perspective view of a frame container tub designed to hold a plurality of patient frames of the present invention for storage, exchange, and insertion into a medication delivery device.
Figure 9:
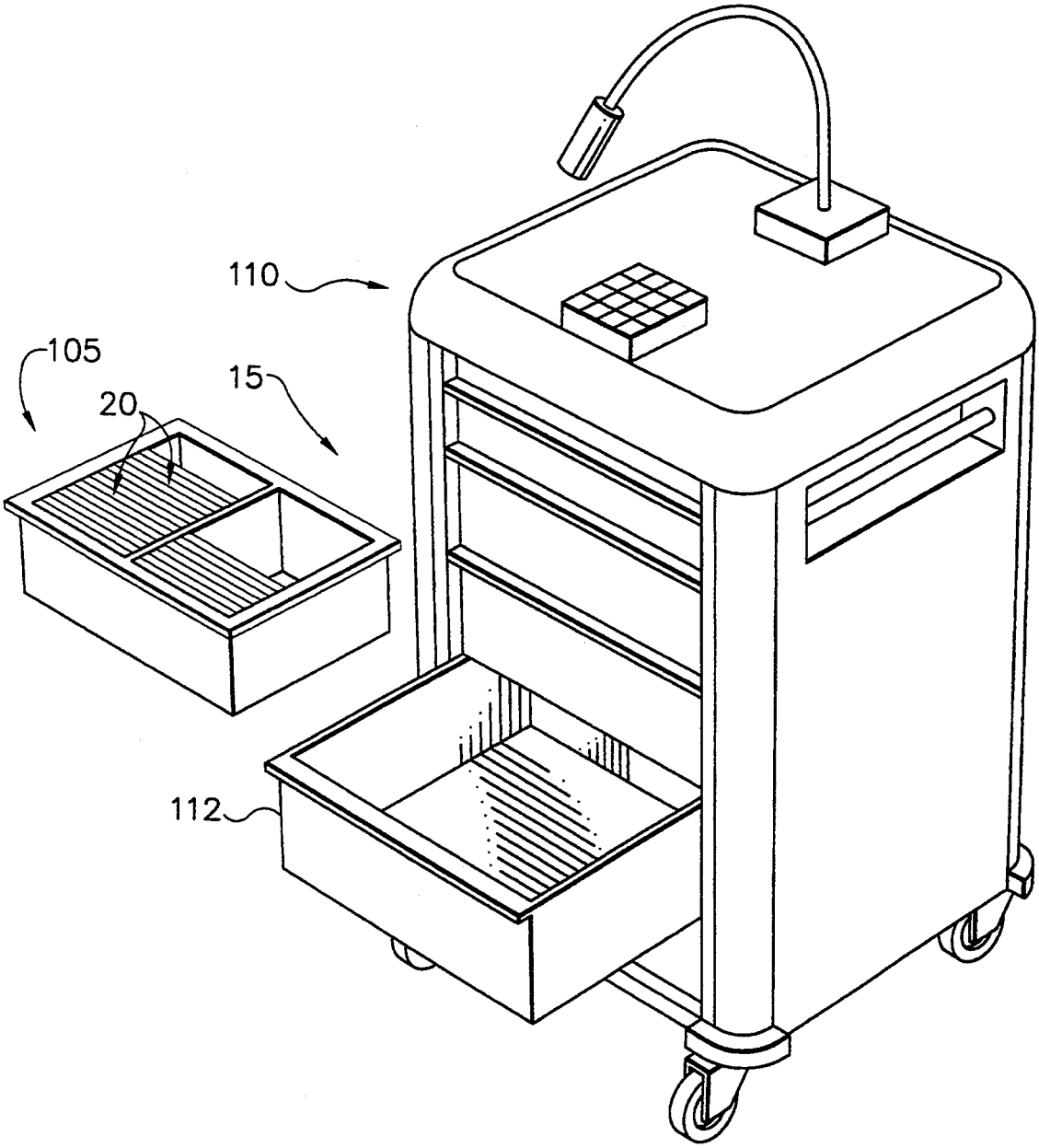
FIG. 9 is perspective view of a medication delivery device into which a frame container tub of the present patient dosing system can be advantageously inserted.

Referring now to the drawings in detail, wherein like numerals indicate the same elements throughout the views, FIGS. 8 and 9 illustrate a preferred embodiment of an exchangeable unit dose medicament dosing system 15 and method of the present invention. As used herein, the term "medicament" is used to broadly describe all types of drugs, medication and other substances which can be distributed in unit doses. FIGS. 1–3 and 7 show details of a preferred integral, reuseable patient dispensing frame or punch frame 20 of dosing system 15, while FIGS. 4–7 show details of a preferred reuseable medicament cartridge 55 which is releasably lockable into dispensing frame 20, as will be described.

Figure 1:
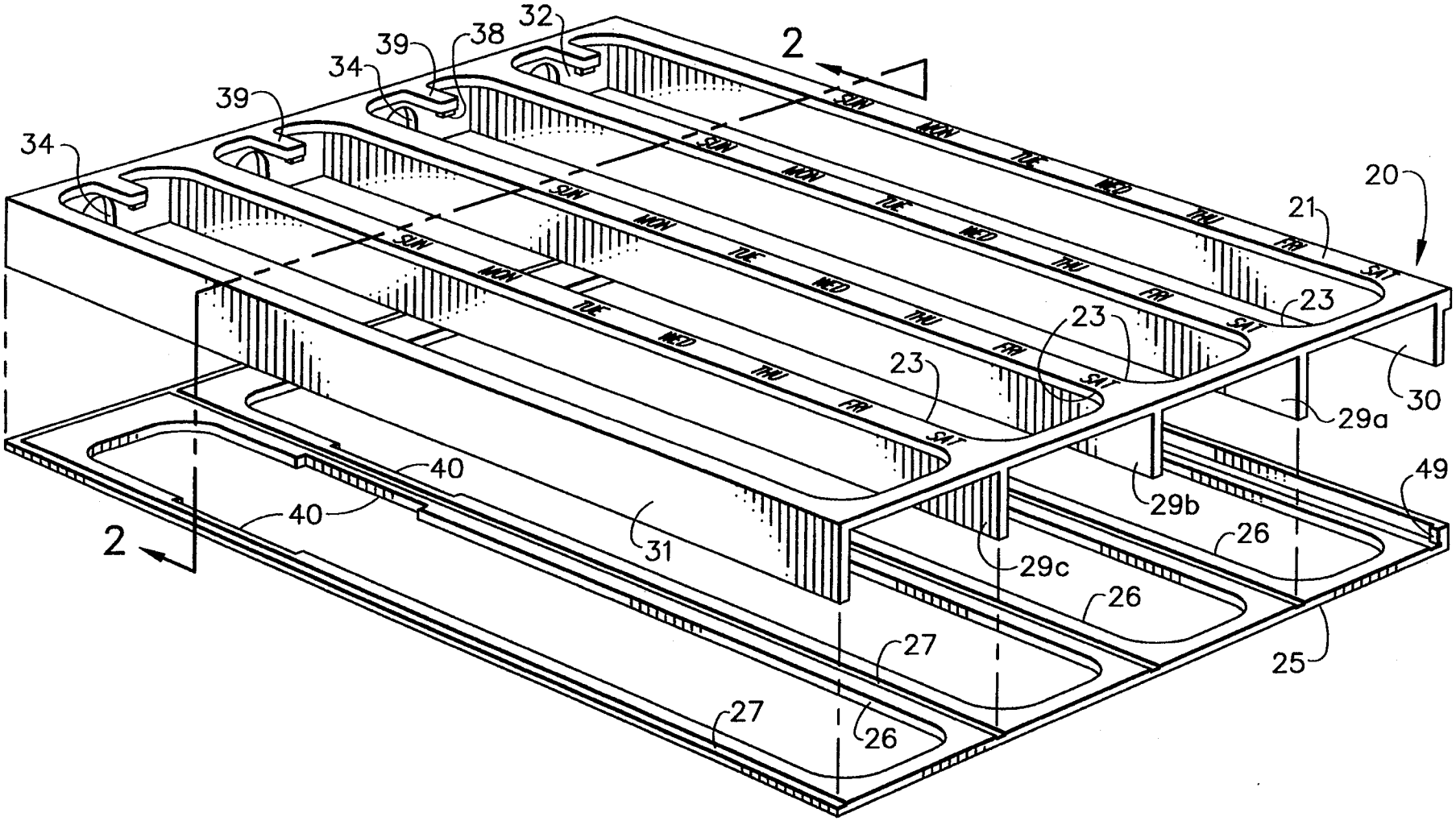
FIG. 1 is a partially exploded perspective view of a preferred embodiment of a patient dispensing frame of the exchangeable patient dosing system of the present invention.
Figure 2:
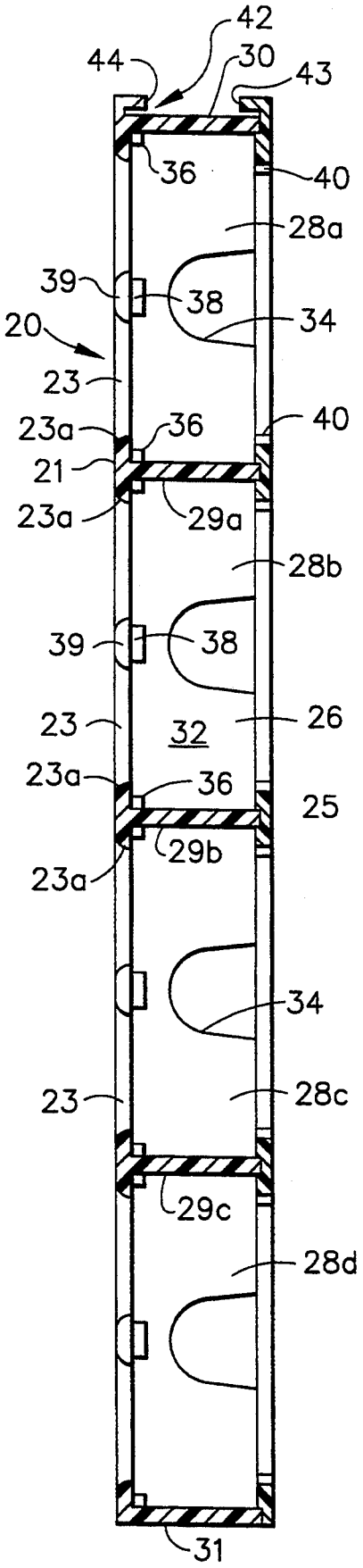
FIG. 2 is a vertical cross-sectional view of the patient frame of FIG. 1, taken along line 2—2 thereof.
Figure 3:
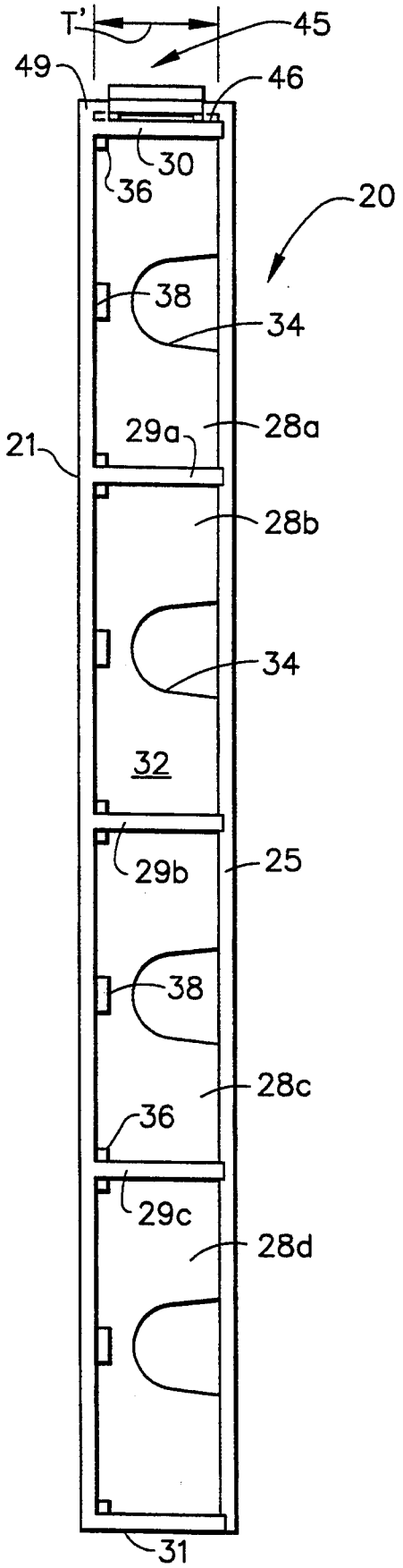
FIG. 3 is a right end view of the patient frame of FIG. 1.

Turning now to FIGS. 1–3, dispensing frame 20 is illustrated as a preferred two-piece assembly comprising, generally, a substantially open front face 21 having a plurality of parallel, longitudinal openings 23. Extending rearwardly from front face 21 along its upper longitudinal edge is top wall 30, while corresponding bottom wall 31 extends rearwardly along the lower longitudinal end thereof. Similarly, support walls **29*a*, 29*b*, and 29*c* depend rearwardly from the respective longitudinal lands of front face 21 defining adjacent openings 23. Depending rearwardly along the left longitudinal edge of front face 21 is left side wall 32, which is formed with a plurality of vertically spaced spare medicament access holes 34, which wi 11** be further described below.

Along the upper edge of front face 21 and along the land areas separating adjacent vertically spaced longitudinal openings 23, there is preferably provided medicament dosing indicia (e.g., as shown in FIG. 1 as indicating the seven days of the week, respectively) to facilitate identification of medication doses held within dispensing frame 20 for dispensing procedures.

Adjacent the left end of openings 23, front face 21 preferably includes a longitudinally extending biasing cantilever 39 supporting a locking latch 38 on its rear surface, as best seen in FIG. 2. Cantilever 39 and its inwardly depending locking latch 38 comprise a preferred arrangement for providing selective and releasable locking interaction of dispensing frame 20 with a slidably inserted cartridge of patient dosing system 15, as will be discussed below.

As also seen in FIGS. 1–3, dispensing frame 20 further preferably comprises a rear surface 25 having a plurality of longitudinal openings 26 generally corresponding with openings 23 of front face 21. While dispensing frame 20 is contemplated as being an integral structure, it may be preferably assembled from two or more pieces connected such as by adhesive, welding, or the like. Punch frame 20 might preferably be provided of a plastic material, such as polystyrene, which can be easily welded by application of heat or ultrasonic procedures. Rear surface 25 may also include longitudinal grooves 27 to facilitate assembly with walls *29a–c*, 30 and 31. As will be appreciated, the preferred integral dispensing frame 20 is effectively provided with four longitudinal cartridge support areas *28a*, *28b*, *28c*, and *28d*, as best seen in FIGS. 2 and 3. In this way, dispensing frame 20 can support up to four reuseable medicament cartridges (55), as will be discussed herein.

As best illustrated in FIG. 2, it is preferred that the peripheral edges (e.g., *23a*) of longitudinal openings of 23 feature an inwardly rounded or arcuate conformation to facilitate comfortable digital dispensing and general handling of the structure of the present patient dosing system 15. Openings 26 of rear surface 25 are illustrated as including a predetermined blister package removal opening 40, as will be described further below.

As seen in FIG. 2, top wall 30 preferably forms the lower portion of a label track 42 having oppositely disposed inwardly extending longitudinal lips 43 and 44, respectively. As best seen in FIG. 8, a removable label card or similar indicia 48 can be slidably inserted within label track 42 to provide convenient identification of patient name, dosing information, prescription information, and the like, in a convenient and reliable fashion. As illustrated in FIGS. 3 and 8, one or more indicator switches (e.g., 45) can also be slidably received within track 42, such as via switch flanges 46 which slidably fit under lips 43 and 44. Switches 45 can be utilized as indicators to facilitate monitoring prescription filling and/or dispensing procedures, or to keep track of other user-identified protocols. Lips 43 and 44 further preferably include stop edges (e.g., 49) which provide an ultimate stop for switches 45 and to prevent their accidental removal from track 42.

Figure 4:
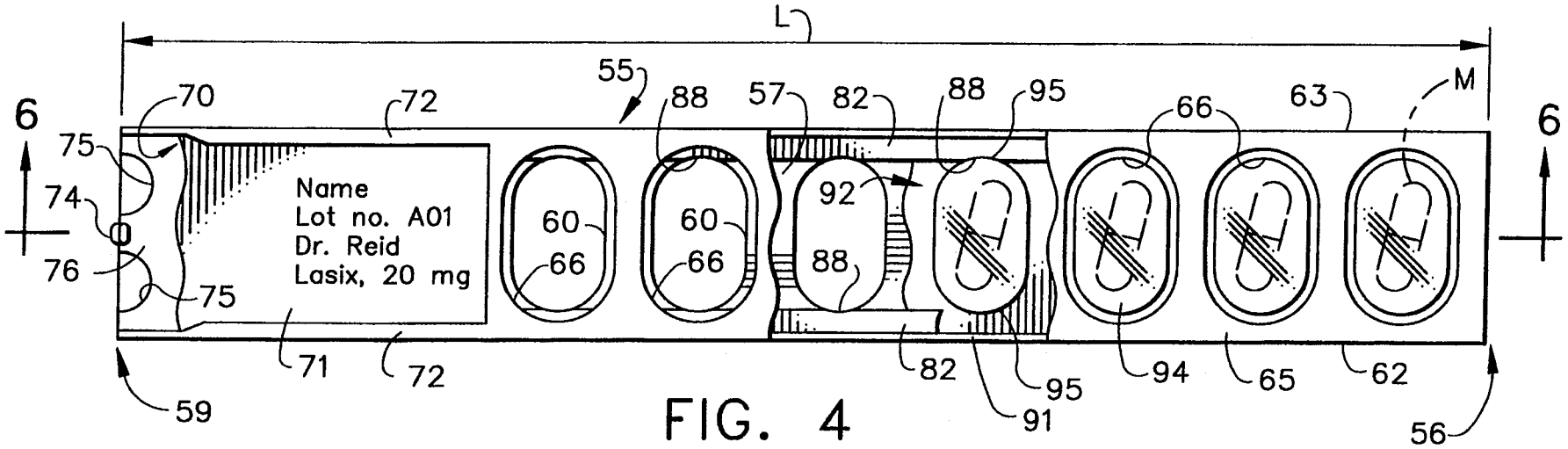
FIG. 4 is a partially broken out, top plan view of a preferred embodiment of an integral reuseable cartridge of a patient dispensing dosing system of the present invention, showing a replaceable blister package therewithin.
Figure 5:
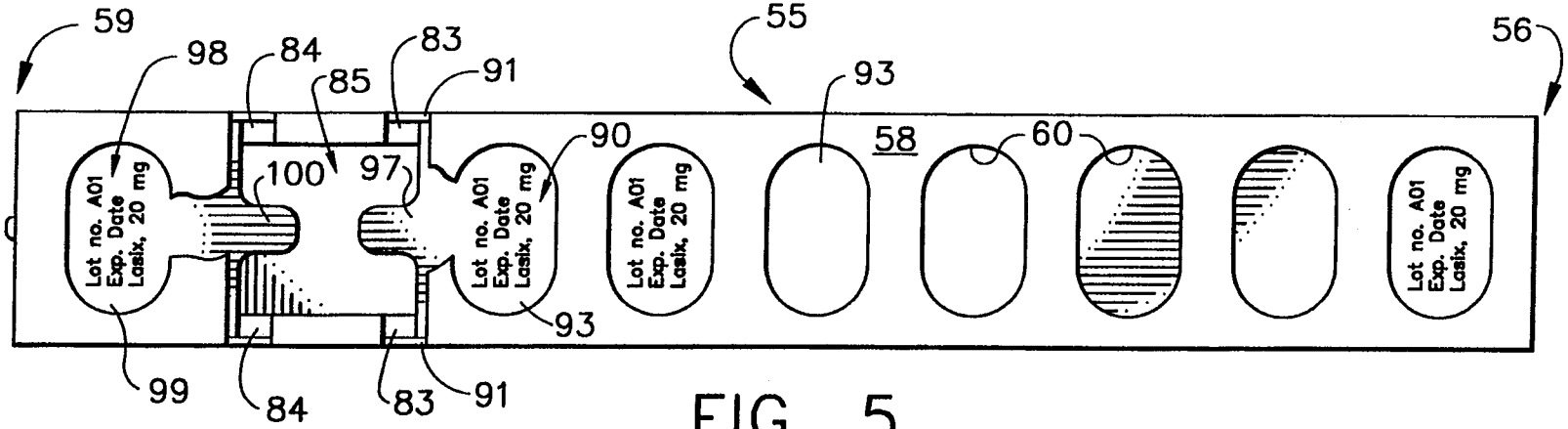
FIG. 5 is a partially broken out rear plan view of the cartridge of FIG. 4.
Figure 6:
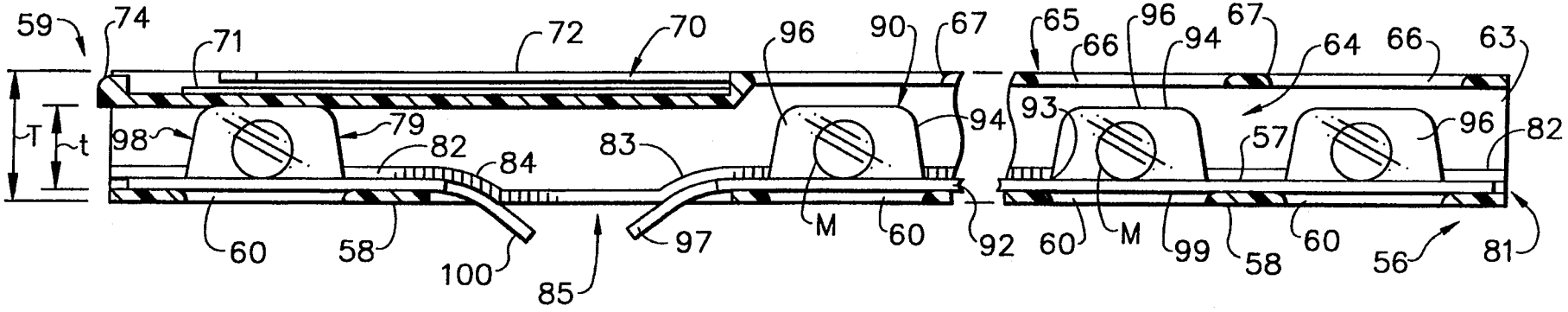
FIG. 6 is a partial vertical cross-sectional view of the cartridge of FIG. 4, taken along 6—6 thereof, and shown with its label placard removed.

Turning now to FIGS. 4–6, a preferred embodiment of a reuseable medicament cartridge 55 of the present invention is illustrated as including a first end 56 and a second end 59, respectively. Cartridge 55 further comprises a medicament support surface 57 preferably arranged as the bottom surface of cartridge 55, having a rear face 58. Support surface 57 further comprises a plurality of obround dispensing openings 60 spaced along the right-most portions of the longitudinal length L thereof.

Front support means or wall 62 is provided along the front portions of support surface 57, and extends upwardly therefrom. Similarly, rear support means or wall 63 extends upwardly from adjacent the rear longitudinal edge of support surface 57. Cartridge 55 further preferably includes a front face 65 having a plurality of obround access openings 66 generally corresponding and vertically aligned with dispensing openings 60. Obviously, the shape of openings 60 and 66 could assume non-obround conformations as desired. While it is contemplated that front face 65 could be omitted in some embodiments, it is preferred to include this structure for added rigidity and protection of medicaments held therewithin.

Support surface 57 and its front and rear support means 62 and 63, respectively, provide a medicament support volume 64 within cartridge 55 having a predetermined effective thickness t, within overall thickness T of the cartridge. Within volume 64, a blister package (90) will be slidably inserted, as described below. A blister receiving means or track 81 is preferably provided within cartridge 55, such as by a pair of oppositely disposed blister track lips or flanges 82. The preferred blister receiving track 81 is best seen in the central broken out section of FIG. 4 and the enlarged sectional view of FIG. 7. Blister track flanges 82 extend inwardly a predetermined distance within support volume 64 in a cantilevered arrangement from front and rear support walls 60 and 63, respectively. These flanges extend along at least a portion of the longitudinal length L of cartridge 55, in generally parallel relationship with support surface 57, as best seen in FIG. 6.

As illustrated in FIGS. 5 and 6, a blister removal opening 85 is provided adjacent the left end of the seven dispensing openings 60 spaced from first end 56 along support surface 57. A blister removal deflector 83 is provided in the form of downwardly curved sections of blister flanges 82. As will be understood, a blister package 90 can be slidably removed from cartridge 55 by pulling package 90 (such as by a pull tab 97) along blister receiving track 81 and outwardly through removal opening 85.

There is preferably provided a spare medicament housing or storage area 79 adjacent the second end 59 of cartridge 55. In this regard, blister track lips 82 are similarly provided in the spare medicament storage area 79 to facilitate retention of a spare blister pack 98 housing an individually sealed medicament dose. It is contemplated that spare blister pack 98 can be prepared along with the balance of blister package 90 in a continuous longitudinal strip (e.g., 92), and thereafter detached for separate insertion into spare storage area 79. A blister removal deflector 84 is also provided as a downwardly curved portion of blister track flanges 82 adjacent storage area 79, and this resulting track can be utilized for both insertion and removal of spare blister pack 98. In this way, a spare unit dose of medicament can be easily inserted via deflector 84 into storage area 79, and can be removed via a pull tab (e.g., 100) extending from spare blister pack 98 and/or with the assistance of an object such as a common pen or pencil inserted through access opening 34 of dispensing frame 20 and the open end 59 of cartridge 55.

As best seen in FIGS. 4, 6 and 7, the upper portions of second end 59 of cartridge 55 further preferably includes a label retaining groove or track 70 having a pair of oppositely disposed label retaining lips 72 and into which a label placard 71 can be slidably inserted. By providing a removable label placard 71 and retaining groove 70, patient and prescription information can be readily and dependably associated with medicament cartridge 55 without having to adhesively attach stickers or the like thereto. In this way, conventional stick-on labels, which can be both difficult to accurately place and to remove on reuseable containers, are not attached directly to the reuseable portion of the system.

To insure that the label placard remains in place within groove 70, an upwardly extending locking tang 74 is also provided. In a preferred embodiment, locking tang 74 not only prevents a label placard 71 from sliding out of its retained position within groove 70, but can also simultaneously serve as a corresponding selective locking element with locking latch 38 of dispensing frame 20. As indicated in FIGS. 7 and 8, as medicament cartridge 55 is slidably inserted into a cartridge support area (e.g., 28*a*) locking tang 74 will physically encounter, slide under, and lock with locking latch 38 to releasably lock cartridge 55 within dispensing frame 20. To further accommodate this physical locking action, it is preferred to provide locking tang 74 in a biased manner, such as via cantilevered finger 76, to allow for additional displacement as locking tang 74 moves past locking latch 38 into locking engagement.

As seen in the left breakout section adjacent second end 59 in FIG. 4, a pair of oppositely disposed scallops or cut-outs 75 can be provided adjacent tang 74 to effectively cantilever finger 76. While other releasable locking arrangements could be equally be substituted to selectively hold a cartridge 55 within dispensing frame 20 (e.g., frictional arrangements, bayonet fittings, etc.), this biased locking assembly is a preferred arrangement due to its simplicity and positive locking characteristics.

As best seen in FIGS. 4–6, exchangeable dosing system 15 further preferably comprises a specially designed blister package 90 including a longitudinal strip 92 comprising a plurality of spaced pockets 94 for housing a predetermined number of unit doses of medicament M. It is contemplated that blister package 90 would generally be formed as a multi-layer punch card type structure having a lower sealing surface 93 sealed about the open lower periphery of a plurality of open blisters or bubbles 96, as commonly available in the industry. Such packaging can provide an excellent seal and protection for medicament M at relatively low cost.

As mentioned, longitudinal strip 92 is formed with oppositely disposed longitudinal edges (e.g., 91) which will be received below the oppositely disposed blister track flanges 82 within cartridge 55. It is contemplated that blister package 90 will preferably be slidably inserted into cartridge 55 from adjacent first end 56, and that the individual pockets 94 will be centered and aligned with corresponding dispensing openings 60 and access openings 66 of cartridge 55.

In order to further simplify the loading procedure of blister package 90, and to insure its proper alignment and retention within cartridge 55, it is preferred that blister package 90 further include alignment means for mechanically interacting with corresponding alignment structure of cartridge 55. A preferred arrangement for providing such mechanical interaction is best seen in the central broken out section of FIG. 4. Particularly, one or more blister alignment means 88 is provided in the form of a recess located along the longitudinal length of blister track flanges 82. A pair of such recesses 88 is shown as being aligned with the center of a corresponding dispensing opening 60 for interaction with protuberances 95 formed on opposite sides of the corresponding pocket 94 of blister package 90. Particularly, protuberances 95 can be provided in the form of a slightly oversized obround blister 96, wherein each recess 88 has an arcuate shape corresponding to the end surface of such obround blister.

Similarly, a rib or other protuberance could also be formed along one edge of blister 96, or, alternately, a protuberance could be provided along blister track flange 82 to interact with a recess formed in blister 96. As illustrated, it is preferred that a plurality of pairs of recesses 88 be provided along the length of oppositely disposed flanges 82 to similarly align each of the spaced pockets 94 of a blister package 90 within a cartridge 55. It is also contemplated that one or more protuberances could similarly be provided within blister receiving track 88 for interaction with recesses formed along the outwardly disposed longitudinal edges of strip 92. In fact, a plethora of varying combinations of protuberances and recesses could easily be substituted to provide a mechanical interaction to properly align and hold blister package 90 as it is slidably received within cartridge 55.

Turning now to FIG. 8, dispensing frame 20 is shown with one medicament cartridge 55 fully slidably inserted and locked therewithin, and another cartridge shown partially inserted therein for illustrative purposes. As seen in FIGS. 2, 3 and 7, dispensing frame 20 preferably includes one or more cartridge stops 36 provided adjacent left side wall 32 to limit the sliding motion of a cartridge 55 as it is inserted into a cartridge support area (e.g., 28*a*–28*d*). As will be understood from FIG. 7, it is preferred that a fully inserted medicament cartridge 55 will be releasably locked within frame 20 in a predetermined position by interaction of locking tang 74, latch 38, and at least one cartridge stop 36.

Each medicament cartridge 55 is loaded with medicament via slidable longitudinal insertion of a blister package 90 from adjacent first end 56, and separate installation of spare blister pack 98 (which might preferably be removed from longitudinal strip 92 via perforations or the like) through opening 85. Slidable insertion is thereby conveniently accomplished without a need to open any part of modular cartridge 55, and cartridge 55 need have no moving parts or hinges to accommodate the loading or unloading of blister packs. Patient and prescription information can thereafter be placed onto a label placard 71 which is inserted into retaining groove 70 of the cartridge 55, and the cartridge is then ready for insertion into a patient dispensing frame 20. Spare medicament pack 98 is also safely stored below label retaining groove 70, further minimizing potential pilfering of medication.

As will be appreciated, up to four separate prescriptions can be placed within a single dispensing frame 20, and general patient and dosing information is inserted via a label 48 within label track 42 of frame 20. Specific patient and prescription information is also provided on each individual cartridge as well (via label track 70 and label placard 71).

Individual patient dispensing frames can be identified for organization into a variety of dispensing modes, such as patient pass, time pass, or prescription pass, as desired. A plurality of dispensing frames for one or more patients can thereafter be placed within a frame container tub 105, which may itself comprise one or more frame receptacles 106 separated by a transverse divider (e.g., 107) and/or one or more loose (e.g., 109) or fixed position (e.g., 108) longitudinal dividers. Frame container tub 105 provides a convenient mode for exchanging a plurality of patient frames 20, and can optionally include a removable lid (not shown) to facilitate exchange procedures, storage and shipping. In this way, patient frames can also be organized in a variety of dispensing modes within one or more frame container tubs 105 for convenient exchange and dispensing implementation.

As seen in FIG. 9, the exchangeable patient dosing system 15 of the present invention can further comprise a medication delivery device such as medication cart 110. It is contemplated that frame container tub 105 can be so sized as to conveniently fit into a conventional drawer 112 of a medication cart or other medication delivery device. In this way, long term health care providers need only insert a frame container tub 105 into a drawer 112 of a medication cart to be ready to begin medication procedures.

Patient frames can be easily added or removed from tub 105, as needed, and the frames can be easily organized and reorganized to adapt to changing dispensing needs. After a predetermined time period (e.g., seven or 30 days) an entire frame container tub 105 can be removed from cart 110 and replaced by a corresponding tub already loaded for the subsequent time period. The used frame container tub 105 can be returned to a pharmacy for refilling. This system can thereby obviate a need for maintaining a medication inventory at the health care facility itself.

As will be appreciated, upon receiving a patient dispensing frame 20 which has been used, a pharmacist can easily remove a dispensing frame 20 from frame container tub 105, withdraw the individual cartridges 55 from within the frame 20, and remove used blister packages 90 therefrom by slidably pulling the packages through blister removal opening 85, as described above. The cartridge can then be loaded with a new blister package, either for the same patient or a different patient. If the medication is the same, and the patient and dosing information also remains the same, label placard 71 may or may not need to be replaced or updated. Similarly, patient and dosing information set forth on label 48 of dispensing frame 20 may or may not need to be updated or changed by the pharmacist.

As mentioned above, it is contemplated that both dispensing frame 20 and cartridges 55 can be provided in the form of reuseable plastic materials, which are both easy to clean and sturdy for extended use and reuse. Both cartridge 55 and frame 20 are preferably provided as modular, integral units which are all essentially identical in construction and use. As such, training for loading, unloading, dispensing, and general use and handling of exchangeable system 15 is minimized and uniform. Moreover, large inventories of various parts are not needed.

As best seen in FIGS. 5, blister package 90 can preferably be provided with individual medicament labeling on the back side of its sealing surface 93. In this way, individual dosing indicia can be visually accessed by simply the viewing the back side of frame 20, as the individual label indicia will show through dispensing openings 60 of cartridges 55 therewithin. Similarly, while no dispensing opening 60 would necessarily be needed for spare medicament storage area 79, provision of an obround opening 60 also enables the pharmacist and health care worker to quickly determine the presence and identity of such spare medicament.

As also illustrated in FIGS. 4 and 6, access openings 66 and dispensing openings 60 are preferably formed with edges rounded inwardly in the direction of medicament dispensing. As will be understood, to dispense a particular medicament M, a health care worker would simply press downwardly through access opening 66 against pocket 94, collapsing the pocket and pushing medicament M through the frangible sealing surface 93. These downwardly curved surfaces provide for more comfortable and safe dispensing procedures. Particularly, once one or more of the medicament's M have been dispensed, the torn portions of sealing surface 93 can extend partially through dispensing opening 60. The curved, smooth edges of dispensing openings 60 also tend to facilitate removal procedures by effectively funneling the torn blister package portions back into support volume 64 as blister package 90 is removed through removal opening 85.

Having shown and described the preferred embodiments of the present invention, further adaptions of the exchangeable unit dose system and method of the present invention can be accomplished by appropriate modifications by one of ordinary skill in the art without departing from the scope of the present invention. Several of such potential modifications have been mentioned, and others will be apparent to those skilled in the art.

For example, while support walls 62 and 63 have been illustrated as substantially continuous closed structures, they could equally be provided in the form of one or more spaced support posts or columns to reduce the weight or material useage of cartridge 55. Similarly, dispensing frame support walls *29a–29c* and top and bottom walls 30 and 31 could equally be perforated or otherwise modified to reduce the material useage and overall weight of the system. Additionally, while cartridge 55 has been illustrated as being slidably insertable into an open end of dispensing frame 20 (see FIG. 8), in an alternate embodiment cartridge 55 might be snap-locked into dispensing frame 20 from the front or rear face thereof. Similarly, cartridge 55 and frame 20 might be modified to provide for an exchange period different than the seven day program as generally illustrated herein.

Accordingly, the scope of the present invention should be considered in terms of the following claims and is understood not to be limited to the details of structure and operation shown and described in the specification and drawings.

I claim:

1. An exchangeable patient dosing system for medicaments, said system comprising:

at least one reusable cartridge having a longitudinal length and oppositely disposed first and second ends, and a medicament support surface having a plurality of longitudinally spaced dispensing openings formed therethrough;

a replaceable blister package comprising a longitudinal strip having a number of individually sealed spaced pockets corresponding in number and spacing with said dispensing openings of said cartridge and each housing a certain dose of medicament to be dispensed, said strip being slidably insertable into and removable from said reusable cartridge;

a reusable patient dispensing frame, said frame comprising means for receiving and releasably supporting a plurality of said cartridges such that medicament housed within said blister package can be dispensed through said cartridge dispensing openings without removing said cartridge from said frame; and means associated with said cartridge for releasably locking said cartridge at least partially within said reusable dispensing frame.

2. The patient dosing system of claim 1 wherein said frame comprises indicia for days of the week corresponding with aligned cartridges and blister package pockets held therewithin to facilitate identification of medicaments to be dispensed at particular times.

3. The patient dosing system of claim 1, wherein said frame further comprises means for receiving a removable label for identifying medicament dosing and patient information for cartridges associated with said frame.

4. The patient dosing system of claim 2, wherein said cartridges each comprise seven dispensing openings and said dispensing frame comprises means for receiving and supporting up to four cartridges, thereby providing a seven day exchange system for a patient requiring up to four separate unit doses of medicaments.

5. The patient dosing system of claim 1, further comprising a frame container for supporting a plurality of patient frames and providing physical and visual access thereto for storage, use and exchange.

6. The patient dosing system of claim 5, wherein said frame container comprises a tub designed for insertion into or connection to another medication delivery device.

7. The patient dosing system of claim 6, wherein said tub has dimensions corresponding with a drawer of a medication cart, whereby said tub with one or more patient dispensing frames can be readily inserted into or removed from such drawer to facilitate exchange procedures.

8. A method for providing a patient dosing system wherein multiple unit dose prescriptions for one or more patients can be readily accommodated in a predetermined time period exchange program, said method comprising the steps of:

providing at least one integral reusable cartridge having a longitudinal length and oppositely disposed first and second ends, and a medicament support surface having plurality of longitudinally space dispensing openings formed therethrough;

providing a replaceable blister package comprising a longitudinal strip having a number of individually sealed spaced pockets corresponding in number and spacing with said dispensing openings of said cartridge and each housing a certain dose of medicament to be dispensed, said strip being slidably insertable into and removable from said reusable cartridge;

providing at least one reusable patient dispensing frame, said frame comprising means for receiving and releasably supporting a plurality of said cartridges such that medicament housed within said blister package can be dispensed through said cartridges dispensing openings without removing said cartridge from said frame;

providing means associated with said cartridge for releasably locking said cartridge at least partially within said reusable dispensing frame;

dispensing medicaments from said patient frame as appropriate and without removing said blister package or said cartridge therefrom; and exchanging a used patient frame for another patient frame when said medicament in said used patient frame has been dispensed or a predetermined time period has passed, whereby said cartridge can be removed from said used patient frame to enable slidable removal of said blister package and refill with a blister package containing medicaments for subsequent dispensing.

9. The method of claim 8, further comprising the step of providing a frame container for supporting a plurality of patient frames and providing physical and visual access thereto for storage, use and exchange.

10. The method of claim 9, wherein said frame container comprises a tub designed for insertion into or connection to another medication delivery device.

11. The method of claim 10, comprising the step of placing a plurality of patient frames within said tub, and exchanging a tub having a plurality of prefilled patient frames for a similar tub having a plurality of used patient frames following a predetermined exchange time period.

12. The method of claim 11, further comprising the step of providing a removable label on each patient frame within said tub for identifying medicament dosing and patient information for cartridges associated with said frame.

13. The method of claim 8, further comprising the step of providing each of said cartridges with seven dispensing openings and providing said dispensing frame with means for receiving and supporting up to four cartridges, and exchanging said dispensing frame after a time period of seven days.

* * * * *